US009442442B1

(12) United States Patent
Hara et al.

(10) Patent No.: US 9,442,442 B1
(45) Date of Patent: Sep. 13, 2016

(54) IMAGE FORMING APPARATUS CAPABLE OF SWITCHING A FIXING TEMPERATURE WHEN RECORDING MEDIUM IS METALLIC PAPER

(71) Applicant: FUJI XEROX CO., LTD., Tokyo (JP)

(72) Inventors: Toko Hara, Kanagawa (JP); Aya Kakishima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/989,078

(22) Filed: Jan. 6, 2016

(30) Foreign Application Priority Data

Jul. 14, 2015 (JP) ..... 2015-140490

(51) Int. Cl.
*G03G 15/20* (2006.01)

(52) U.S. Cl.
CPC ..... *G03G 15/2053* (2013.01)

(58) Field of Classification Search
CPC ..... G03G 15/2039; G03G 15/2046; G03G 15/205
USPC ..... 399/69
See application file for complete search history.

(56) References Cited

U.S. PATENT DOCUMENTS 6,751,425 B2 * 6/2004 Fujimori et al. ... G03G 15/2039 399/69
8,433,212 B2 * 4/2013 Ono ..... G03G 15/2039 399/69
8,737,860 B2 * 5/2014 Katakura ..... G03G 15/2078 399/69
9,025,982 B2 * 5/2015 Kameda ..... G03G 15/2085 399/69

FOREIGN PATENT DOCUMENTS

JP 2000-075584 A 3/2000

* cited by examiner

*Primary Examiner* — William J Royer
(74) *Attorney, Agent, or Firm* — Oliff PLC

(57) ABSTRACT

An image forming apparatus includes an image forming section and a fixing section. The image forming section forms a toner image and transfers the toner image to a recording medium. The fixing section heats the recording medium, to which the toner image is transferred, to fix the toner image to the recording medium. The fixing section is capable of switching a fixing temperature between a first fixing temperature and a second fixing temperature lower than the first fixing temperature. If the recording medium is metallic paper including a metallic layer and a resin layer that covers the metallic layer, the fixing section heats the recording medium at the second fixing temperature to fix the toner image to the recording medium.

6 Claims, 7 Drawing Sheets

FIG. 6

| NAME OF MANUFACTURER | PAPER KIND NAME |
|---|---|
| | FOILJET (Indigo PAPER) |
| GOJO PAPER MFG. CO., LTD. | SPECIALITIES PET PAPER No. 305 |
| | SPECIALITIES PET PAPER No. 312 |
| | SPECIALITIES PET PAPER No. 315 |
| | SPECIALITIES PET PAPER No. 319-1 |
| | SPECIALITIES ALUMINUM No. 206 |
| | SPECIALITIES ALUMINUM DEPOSITION TRANSFER G·T·1-FS |
| | SPECIALITIES ALUMINUM PASTE 1620 |
| TOKYO PAPER MFG. CO., LTD. | COMPASSO F-12 300 g/m$^2$ Al DEPOSITION PET JOINED SILVER |
| | SAINT ECO 256 gsm PLAIN SILVER |
| HEIWA PAPER CO., LTD. | MIRALOOK |
| | HIGHPIKA E2F |
| OJI PAPER CO., LTD. | OFF-METAL N SILVER 187.5 g/m$^2$ |
| | OFF-METAL NP |
| KISO CHEMICAL CO., LTD. | METALLIC PAPER FOR OKI |
| LINTEC CORPORATION | S GLOSS |
| HOKUETSU KISHU PAPER CO., LTD. | VM12 |
| | VM25 |
| | PERMI |
| | MARIEST |
| | NEW METALLIC COLOR |
| TOKYO PAPER MFG. CO., LTD. | METALOOK |
| | METADEEP |
| | HIGHBOHN |
| | METADRESS |
| | PAINTAS |
| | COMPASSO A ALUMINUM JOINED PAPER |
| | COMPASSO L ALUMINUM PASTE COATED PAPER |
| | COMPASSO F ALUMINUM DEPOSITION PET FILM JOINT |
| | COMPASSO T TRANSFER DEPOSITION PAPER |
| | |

(CONT.)

(FIG. 6 Continued)

| | |
|---|---|
| HEIWA PAPER CO., LTD. | ALBRIGHT DEPOSITION TRANSFER PAPER |
| FUJIKYOWA SEISHI | FANTAS |
| SANDERS | SANDERS METALLIC FS PLATINA |
| YOSHIMORI CO., LTD. | ALPAPER GLOSSY SILVER · ALUMINUM FOIL PAPER |
| | ALPAPER SILVER PRINTED NON-METALLIC PAPER |
| | ALPAPER ALUMINUM DEPOSITION PAPER |
| | ALPAPER GLOSSY SILVER ALUMINUM TRANSFER DEPOSITION PAPER |
| | KUNYMETAL |
| TOKUSHU TOKAI PAPER CO., LTD. | MIRAX AS ALUMINUM FOIL JOINED PAPER |
| | N SUPER MIRAX · MIRAX V05 ALUMINUM DEPOSITION JOINED PAPER |

IMAGE FORMING APPARATUS CAPABLE OF SWITCHING A FIXING TEMPERATURE WHEN RECORDING MEDIUM IS METALLIC PAPER

CROSS-REFERENCE TO RELATED APPLICATIONS

This application is based on and claims priority under 35 USC 119 from Japanese Patent Application No. 2015-140490 filed Jul. 14, 2015.

BACKGROUND

Technical Field

The present invention relates to an image forming apparatus.

SUMMARY

According to an aspect of the invention, an image forming apparatus includes an image forming section and a fixing section. The image forming section forms a toner image and transfers the toner image to a recording medium. The fixing section heats the recording medium, to which the toner image is transferred, to fix the toner image to the recording medium. The fixing section is capable of switching a fixing temperature between a first fixing temperature and a second fixing temperature lower than the first fixing temperature. If the recording medium is metallic paper including a metallic layer and a resin layer that covers the metallic layer, the fixing section heats the recording medium at the second fixing temperature to fix the toner image to the recording medium.

BRIEF DESCRIPTION OF THE DRAWINGS

Exemplary embodiments of the present invention will be described in detail based on the following figures, wherein:

FIG. 6 is a list including examples of the name of a manufacturer of a commercially available metallic paper and examples of a paper kind name.

DETAILED DESCRIPTION

Description will be given of an example of an image forming apparatus according to an exemplary embodiment of the invention. It should be noted that in the accompanying drawings, an arrow H represents a vertical direction, and an arrow W represents an apparatus width direction as a horizontal direction.

<Configuration of Image Forming Apparatus>

Figure 1:
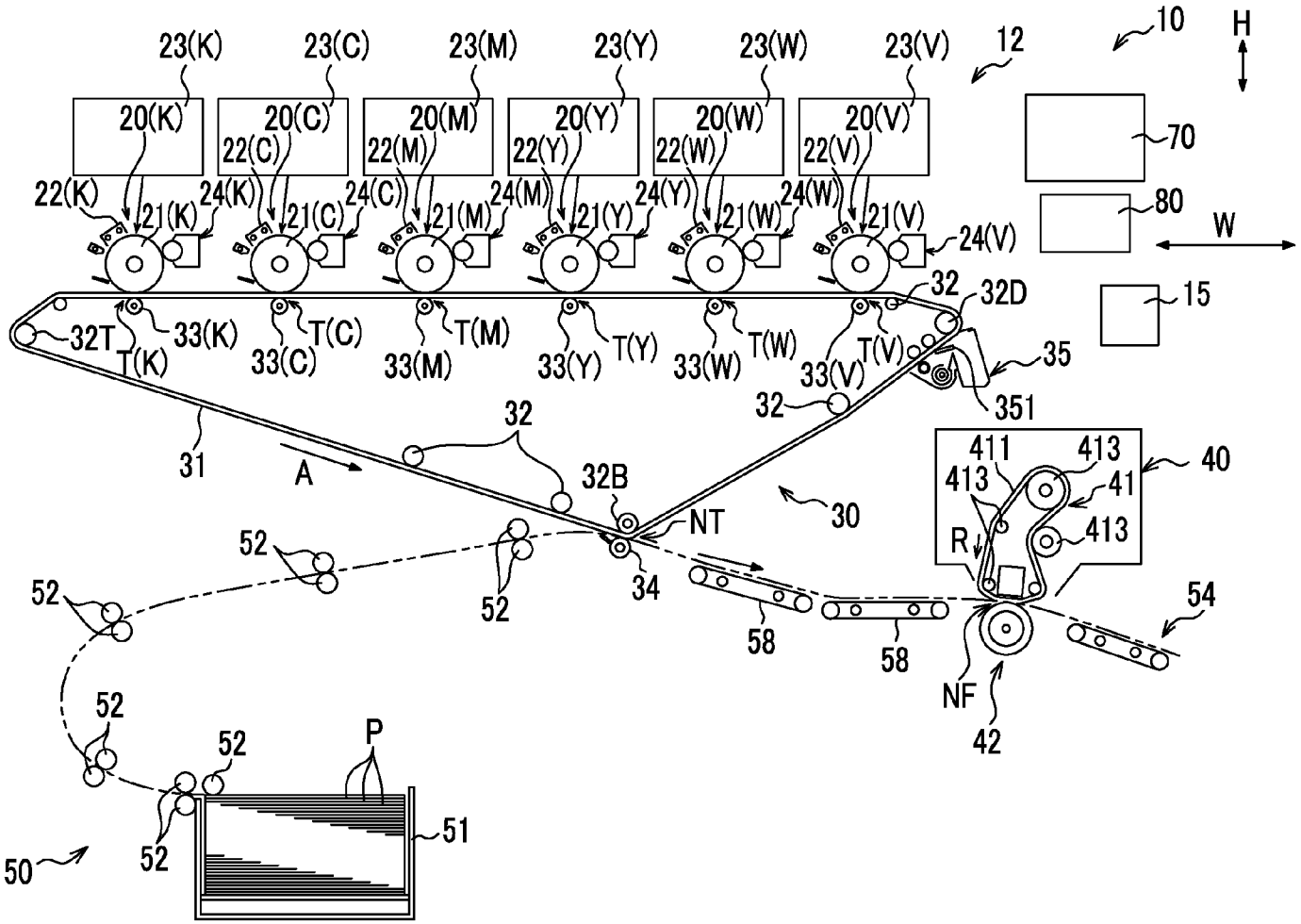
FIG. 1 is a schematic configuration diagram illustrating an image forming apparatus according to an exemplary embodiment of the invention.
Figure 3:
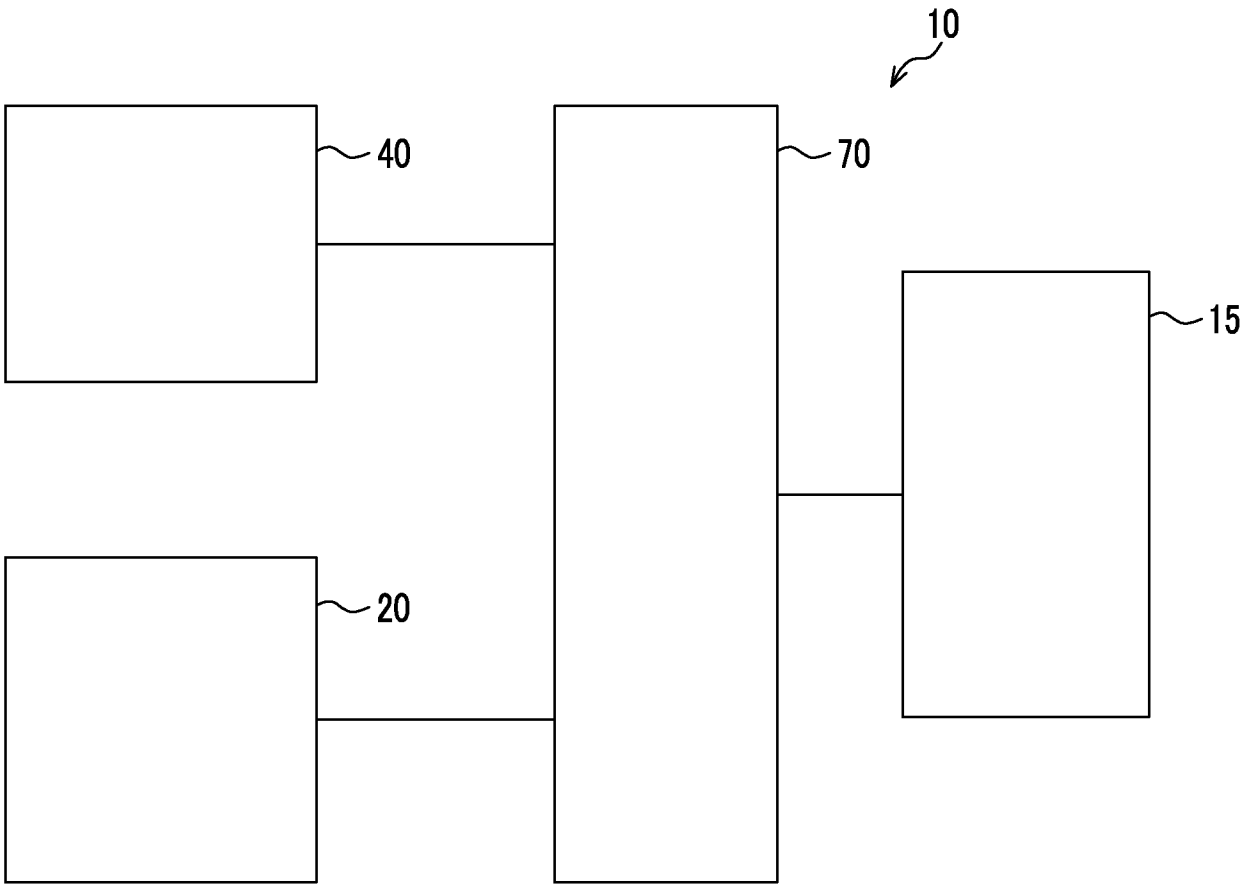
FIG. 3 is a block diagram of the image forming apparatus according to the exemplary embodiment of the invention.

FIG. 1 is a schematic diagram illustrating a schematic configuration when an image forming apparatus 10 is viewed from a front side. As illustrated in the drawing, the image forming apparatus 10 includes an image forming section 12 that forms an image on a paper surface (sheet surface) of a sheet-shaped recording medium (sheet member) P such as paper with an electrophotographic type, a transporting device 50 that transports the recording medium P, a control unit 70 that controls the operation of respective units of the image forming apparatus 10, and a power supply unit 80 that supplies power to respective constituent elements. Also, an operation panel 15 (refer to FIG. 3), to which various operations are performed by a user, is provided in the image forming apparatus 10.

[Transporting Device]

As illustrated in FIG. 1, the transporting device 50 includes a collection vessel 51 in which the recording medium P is collected, and plural transporting rolls 52 which transports the recording medium P from the collection vessel 51 to a secondary transfer position NT to be described later. In addition, the transporting device 50 includes plural transporting belts 58 which transport the recording medium P from the secondary transfer position NT to a fixing device 40, and a transporting belt 54 that transports the recording medium P from the fixing device 40 toward an ejection portion (not illustrated) of the recording medium P.

[Image Forming Section]

The image forming section 12 includes a toner image forming unit 20 that forms a toner image, a transfer device 30 that transfers the toner image formed in the toner image forming unit 20 to the recording medium P, and the fixing device that heats and pressurizes the toner image, which is transferred to the recording medium P, to fix the toner image to the recording medium P.

Each of the plural toner image forming units 20 is provided to form toner images for respective colors. In this exemplary embodiment, toner image forming units 20V, 20W, 20Y, 20M, 20C, and 20K of a total of six colors, which include a first special color (V), a second special color (W), yellow (Y), magenta (M), cyan (C), and black (K), are provided. (V), (W), (Y), (M), (C), and (K), which are illustrated in FIG. 1, represents the above-described respective colors.

It should be noted that in this exemplary embodiment, the first special color (V) is white, and the second special color (W) is a user-specific corporate color. Also, in FIG. 3, a representative one of the toner image forming units 20 is illustrated without the toner image forming units 20 being discriminated from each other (without giving reference numerals thereto).

[Toner Image Forming Unit]

Figure 2:
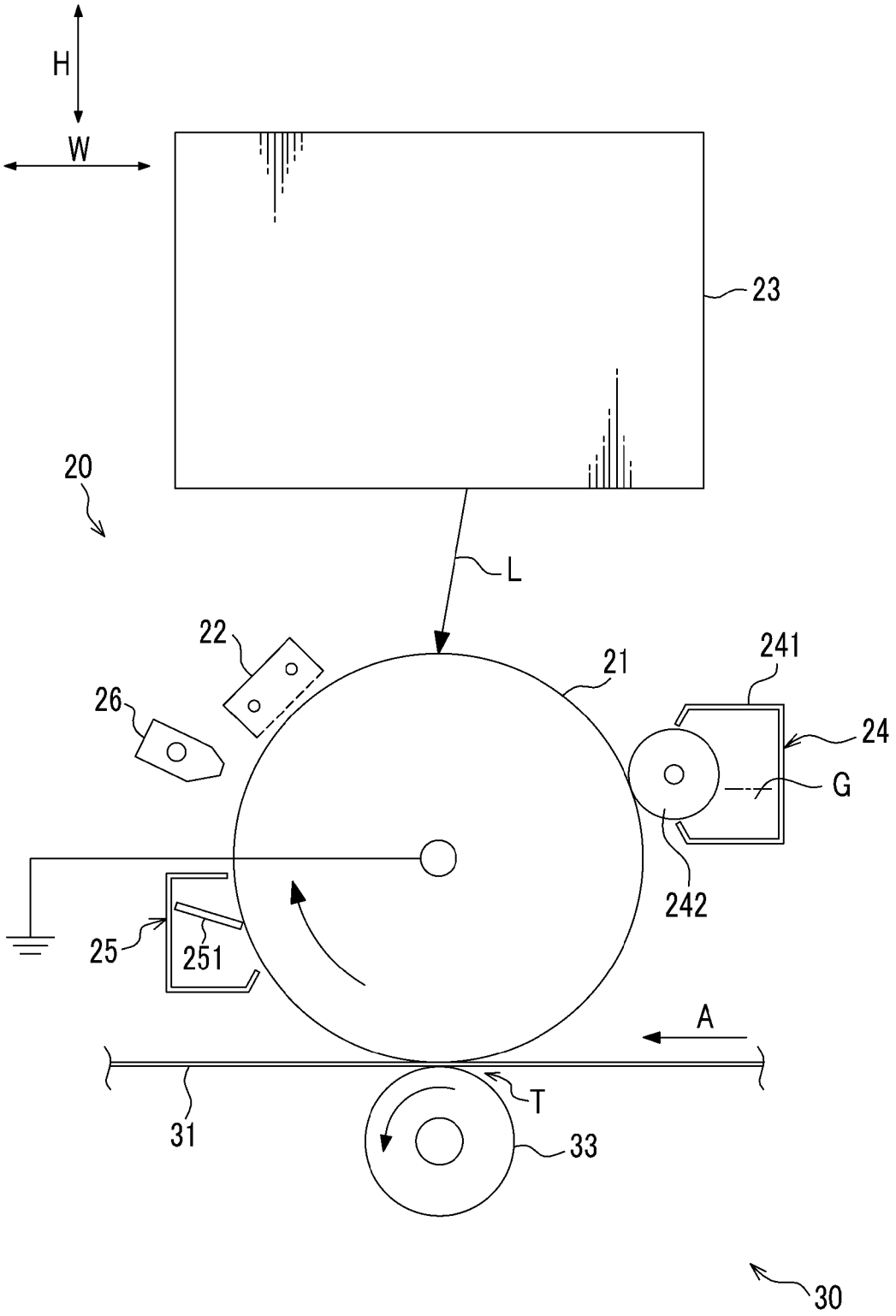
FIG. 2 is a configuration diagram illustrating a toner image forming unit that is provided in the image forming apparatus according to the exemplary embodiment of the invention.

As illustrated in FIG. 1, basically, the toner image forming unit 20 for each color is configured in the same manner except for a toner that is used. Specially, as illustrated in FIG. 2, the toner image forming unit 20 for each color includes a photoconductor drum 21 that rotates in the clock-wise direction in FIG. 2, and a charging unit 22 that charges the photoconductor drum 21. In addition, the toner image forming unit 20 for each color includes an exposure device 23 that exposes the photoconductor drum 21 that is charged by the charging unit 22 to form an electrostatic latent image on the photoconductor drum 21, a developing device 24 that develops the electrostatic latent image that is formed on the photoconductor drum 21 by the exposure device 23 to form a toner image, a cleaning device 25, and a charge eliminating device 26.

(Developing Device)

As illustrated in FIG. 2, the developing device 24 includes a vessel 241 in which a developer G is collected, and a developing roll 242. When a developing bias voltage is applied by the developing roll 242, the electrostatic latent image, which is formed on an outer circumferential surface of the photoconductor drum 21, is developed as a toner image due to a potential difference that occurs between the developing roll 242 and the photoconductor drum 21.

(Cleaning Device)

The cleaning device 25 includes a blade 251 that scraps off a toner, which remains on a surface of the photoconductor drum 21 after transfer of the toner image in the transfer device 30, from the surface of the photoconductor drum 21.

[Transfer Device]

The transfer device 30 primarily transfers the toner image on the photoconductor drum 21 for each color to a transfer belt 31 (intermediate transfer unit) at each primary transfer position T in order for respective toner images to overlap each other, and secondarily transfers the toner images, which overlap each other, to the recording medium P at the secondary transfer position NT. Specifically, the transfer device 30 includes the transfer belt 31, a primary transfer roll 33, and a secondary transfer roll 34 as an example of a transfer member.

(Transfer Belt)

As illustrated in FIG. 1, the transfer belt 31 has an endless shape, and is wound around plural rolls 32. Among the plural rolls 32, a roll 32D functions as a drive roll that allows the transfer belt 31 to circulate in an arrow A direction by using power of a motor (not illustrated). The transfer belt 31 circulates in the arrow A direction and transports the toner images, which are primarily transferred at respective primary transfer positions T and overlap each other, to the secondary transfer position NT.

Also, among the plural rolls 32, a roll 32T functions as a tension apply roll that applies tension to the transfer belt 31. Among the plural rolls 32, a roll 32B functions as a facing roll 32B of the secondary transfer roll 34.

The cleaning device 35 that cleans the transfer belt 31 is disposed on a downstream side of the secondary transfer position NT and an upstream side of the primary transfer position T (V) in the circulation direction (arrow A direction) of the transfer belt 31. The cleaning device 35 includes a blade 351 that scraps off a toner, which remains on a surface of the transfer belt 31, from the surface of the transfer belt 31.

(Primary Transfer Roll)

Each primary transfer roll 33 is a roll that transfers the toner image of each photoconductor drum 21 to the transfer belt 31, and is disposed on an inner side of the transfer belt 31. The primary transfer roll 33 is disposed to face the photoconductor drum 21 of a corresponding color with the transfer belt 31 interposed therebetween. Also, when a primary transfer voltage of a polarity opposite to a toner polarity is applied to the primary transfer roll 33, the toner image, which is formed on the photoconductor drum 21, is transferred to the transfer belt 31 at the primary transfer position T.

(Secondary Transfer Roll)

The secondary transfer roll 34 is a roll that transfers the toner images, which overlap each other on the transfer belt 31, to the recording medium P. The secondary transfer roll 34 is disposed in such a manner that the transfer belt 31 is interposed between the secondary transfer roll 34 and the above-described facing roll 32B, and the secondary transfer roll 34 and the transfer belt 31 contact with each other with a load that is determined in advance. In addition, a position between the secondary transfer roll 34 and the transfer belt 31, which contact with each other, is the secondary transfer position NT. The recording medium P is supplied from the collection vessel 51 to the secondary transfer position NT in a timely manner.

[Fixing Device]

The fixing device 40 fixes a toner image on the recording medium P to which the toner image is transferred. Specifically, the fixing device 40 heats and pressurizes the toner image at a fixing nip NF that is formed between a fixing belt 411 and a pressure roll 42, to fix the toner image to the recording medium P. The fixing belt 411 is wound around plural rolls 413 and is rotated in an arrow R direction.

Also, the fixing device 40 of this exemplary embodiment may switch a fixing temperature at the fixing nip NF between a first fixing temperature (155° C.; standard temperature) and a second fixing temperature (140° C.) that is lower than the first fixing temperature, to perform the fixing.

Furthermore, the fixing device 40 of this exemplary embodiment may switch a fixing speed (transportation speed of the recording medium P) at the fixing nip NF between a first fixing speed (445 mm/s; standard speed) and a second fixing speed (200 mm/s) that is slower than the first fixing speed, to perform the fixing.

The fixing temperatures and the fixing speeds are switched (controlled) by the control unit 70. Also, a transporting speed at the transporting device 50 and the like are appropriately controlled (adjusted) by the control unit 70 in accordance with the fixing speed.

The first fixing temperature, the second fixing temperature, the first fixing speed, and the second fixing speed will be described later.

[Image Forming Operation]

Next, description will be given of summary of a process of forming an image on the recording medium P by the image forming apparatus 10, and a post-processing process.

As illustrated in FIG. 1, the control unit 70, which receives an image forming command, operates the toner image forming unit 20, the transfer device 30, and the fixing device 40. Also, in synchronization with the operation, the control unit 70 operates the transporting device 50 and the like.

The photoconductor drum 21 for each color is charged by the charging unit 22 during rotation. Also, the control unit 70 transmits image data, which is subjected to image processing in an image signal processing unit, to the exposure device 23. Each exposure device 23 emits an exposure light beam L (refer to FIG. 2) in accordance with the image data, and exposes the photoconductor drum 21 that is charged. Thereby, an electrostatic latent image is formed on an outer peripheral surface of the photoconductor drum 21. The electrostatic latent image that is formed on the photoconductor drum 21 is developed by the developing device 24, and toner images of the first special color (V), the second special color (W), yellow (Y), magenta (M), cyan (C), and black (K) are formed on the photoconductor drums 21 for respective colors.

The toner image for each color, which is formed on the photoconductor drum 21 for each color, is sequentially and primarily transferred to the transfer belt 31, which circulates, at each primary transfer position T by the primary transfer roll 33 for each color. According to this, an overlapping toner image, in which toner images corresponding to six colors overlap each other, is formed on the transfer belt 31. The overlapping toner image is transported to the secondary transfer position NT by circulation of the transfer belt 31.

The recording medium P is supplied to the secondary transfer position NT at timing conforming to transportation of the overlapping toner image by the transporting rolls 52. In addition, at the secondary transfer position NT, the overlapping toner image is secondarily transferred from the transfer belt 31 to the recording medium P.

The recording medium P, to which the toner image is secondarily transferred, is transferred toward the fixing device 40 by the transporting belts 58 while being negative-pressure suctioned. The fixing device 40 applies heat and a compression force to the recording medium P that passes through the fixing nip NF. According to this, the toner image, which is transferred to the recording medium P, is fixed to the recording medium P.

The recording medium P, to which the toner image is fixed by the fixing device 40, is transported by the transporting belt 54, and is ejected to the ejection portion (not illustrated).

<Metallic Paper>

Figure 4:
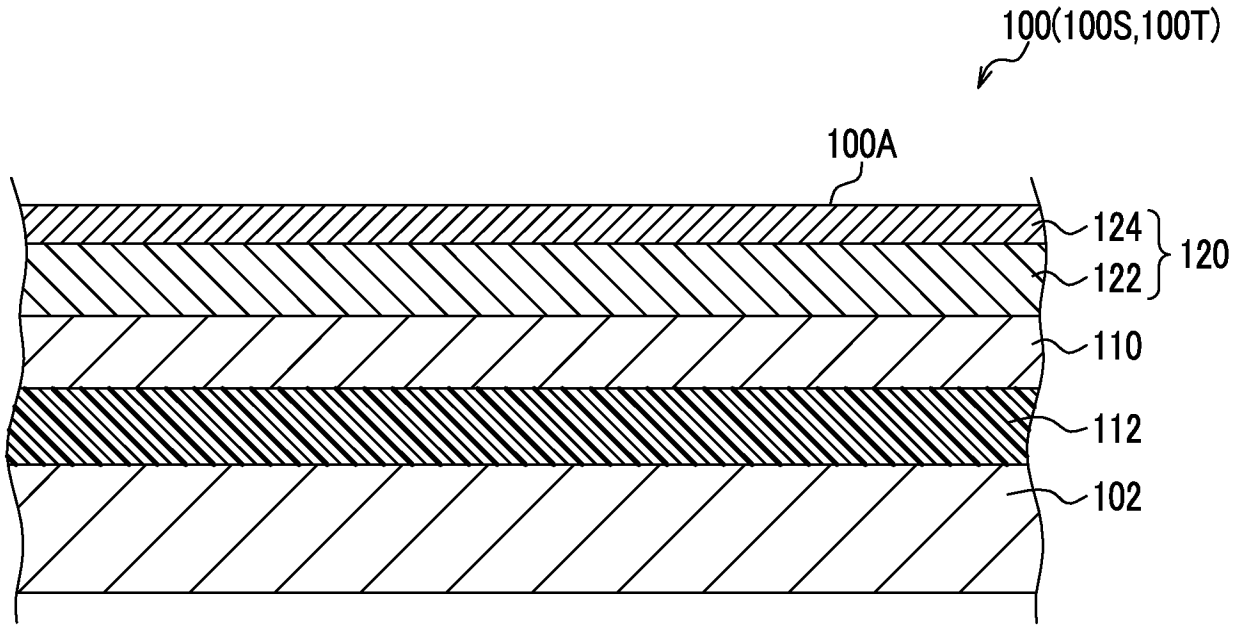
FIG. 4 is a cross-sectional view schematically illustrating a cross-sectional structure of metallic paper.

The image forming apparatus 10 of this exemplary embodiment may form an image on any one of plural kinds of recording media P including metallic paper 100 (refer to FIG. 4). Furthermore, in this exemplary embodiment, the image forming apparatus 10 may form an image on any of two kinds of metallic paper 100 including metallic standard paper 100S and metallic cardboard 100T that is thicker than the metallic standard paper 100S and has a basis weight greater than that of the metallic standard paper 100S.

It should be noted that the basis weight of the metallic standard paper 100S of this exemplary embodiment is 157 gsm or less, and that the basis weight of the metallic cardboard 100T is 158 gsm or greater. Also, the metallic standard paper 100S and the metallic cardboard 100T are different from each other in basis weight, but have the same cross-sectional structure. Accordingly, in the following description, if it is not necessary to discriminate the metallic standard paper 100S and the metallic cardboard 100T from each other, the metallic standard paper 100S and the metallic cardboard 100T may be collectively referred to as the metallic paper 100.

FIG. 4 is a cross-sectional view of the metallic paper 100. As illustrated in the drawing, the metallic paper 100 includes a base 102, an adhesive layer 112, a metallic layer 110, and a resin layer 120.

The base 102 is paper that is configured with a pulp fiber. The adhesive layer 112 is a layer that bonds the metallic layer 110 to the base 102, and contains an acrylic resin as a main component. The metallic layer 110 contains aluminum as a main component.

The resin layer 120 is configured with a first resin layer 122 and a second resin layer 124. The first resin layer 122 contains polyethylene terephthalate as a main component. The second resin layer 124 is a layer that makes up the outermost layer of the metallic paper 100, and contains polyester, polyacrylic urethane, or the like as a main component. Also, a surface of the second resin layer 124 is a sheet surface 100A of the metallic paper 100 to which the toner image is transferred and fixed.

It should be noted that the cross-sectional structure of the metallic paper 100 illustrated in FIG. 4 is an example. For example, the metallic layer 110 may be formed on the base 102 through deposition. Also, for example, the resin layer 120 may be configured with a single layer or three or more layers. In brief, the metallic paper may have a structure that the metallic layer is formed on the base through bonding, deposition, or the like, and the metallic layer is covered with the resin layer.

Examples of the name of a manufacturer of a commercially available metallic paper and a paper kind name are shown in a list of FIG. 6.

<Selection of Paper>

The image forming apparatus 10 of this exemplary embodiment allows a user to operate an operation panel 15 so as to select a kind of the recording medium P on which an image is to be formed. The recording medium P may be selected from among at least standard paper, the metallic standard paper 100S, and metallic cardboard 100T. The standard paper is an example of a recording medium (non-metallic paper) other than the metallic standard paper 100S and the metallic cardboard 100T.

<Control of Fixing Device in Case of Forming Image on Metallic Paper>

Next, description will be given of control of the fixing device 40 in a case of forming images on the metallic standard paper 100S and the metallic cardboard 100T.

In a case where the user operates the operation panel 15 and selects the standard paper (non-metallic paper), the control unit 70 sets a fixing temperature and a fixing speed of the fixing device 40 to the first fixing temperature and the first fixing speed, respectively.

In a case where the user selects the metallic standard paper 100S, the control unit 70 sets the fixing temperature and the fixing speed of the fixing device 40 to the second fixing temperature and the first fixing speed, respectively.

In a case where the user selects the metallic cardboard 100T, the control unit 70 sets the fixing temperature and the fixing speed of the fixing device 40 to the second fixing temperature and the second fixing speed, respectively.

<Operation>

Next, description will be given of an operation of this exemplary embodiment.

First, description will be given of a comparative example in a case where toner images are fixed to the metallic standard paper 100S and the metallic cardboard 100T at the first fixing temperature and the first fixing speed which are the same as those for the standard paper (non-metallic paper).

In the comparative example, toner images are fixed to the metallic standard paper 100S and the metallic cardboard 100T at the first fixing temperature and the first fixing speed which are the same as those for the standard paper, and then white turbidity may occur in the paper (discoloration may occur).

From analysis performed by the inventors to find causes of the white turbidity, the inventors find the following two causes.

(1) Modification of the resin layer 120 (mainly second resin layer 124) due to heat during fixing.

(2) Scattered reflection of light which occurs when the metallic layer 110 and the resin layer 120 are separated and peeled from each other, and a boundary portion between the metallic layer 110 and the resin layer 120 changes into a wave shape.

Next, description will be given of the analysis of the two causes.

(1) From a result of analysis (DSC) of the resin layer 120 after the metallic paper 100 is heated, it is apparent that an exothermic reaction occurs at a predetermined temperature and some chemical reaction occurs. When analysis is performed while heating conditions are changed, it is observed that a stretching vibration band of urethane C=0 varies. Also, if a temperature is a predetermined temperature or lower, the stretching vibration band of urethane C=0 does not vary even though heating time is changed. From these results, it is assumed that a block agent, which is contained in the resin layer 120 (mainly, the second resin layer 124), is dissociated through heating, and a curing reaction (modification) occurs.

(2) From analysis of a cross-section of the metallic paper 100, to which fixing is performed and in which white turbidity occur, it is observed with a SEM that the metallic layer 110 and the resin layer 120 are separated and peeled from each other that a boundary portion therebetween has a wave shape, and that a gap is partially generated therebetween. From this result, it is assumed that the metallic layer 110 and the resin layer 120 are separated and peeled from each other, and thus scattered reflection of light occurs at the boundary portion therebetween.

Furthermore, particularly from (1), it is assumed as follows.

(3) The white turbidity is not sensitive to the heating time (amount of heat) of the metallic paper 100, but is sensitive to the heating temperature (fixing temperature).

Next, description will be given of a result of investigation of occurrence of the white turbidity by changing the fixing temperature of the fixing device 40 in the image forming apparatus 10.

Figure 5:
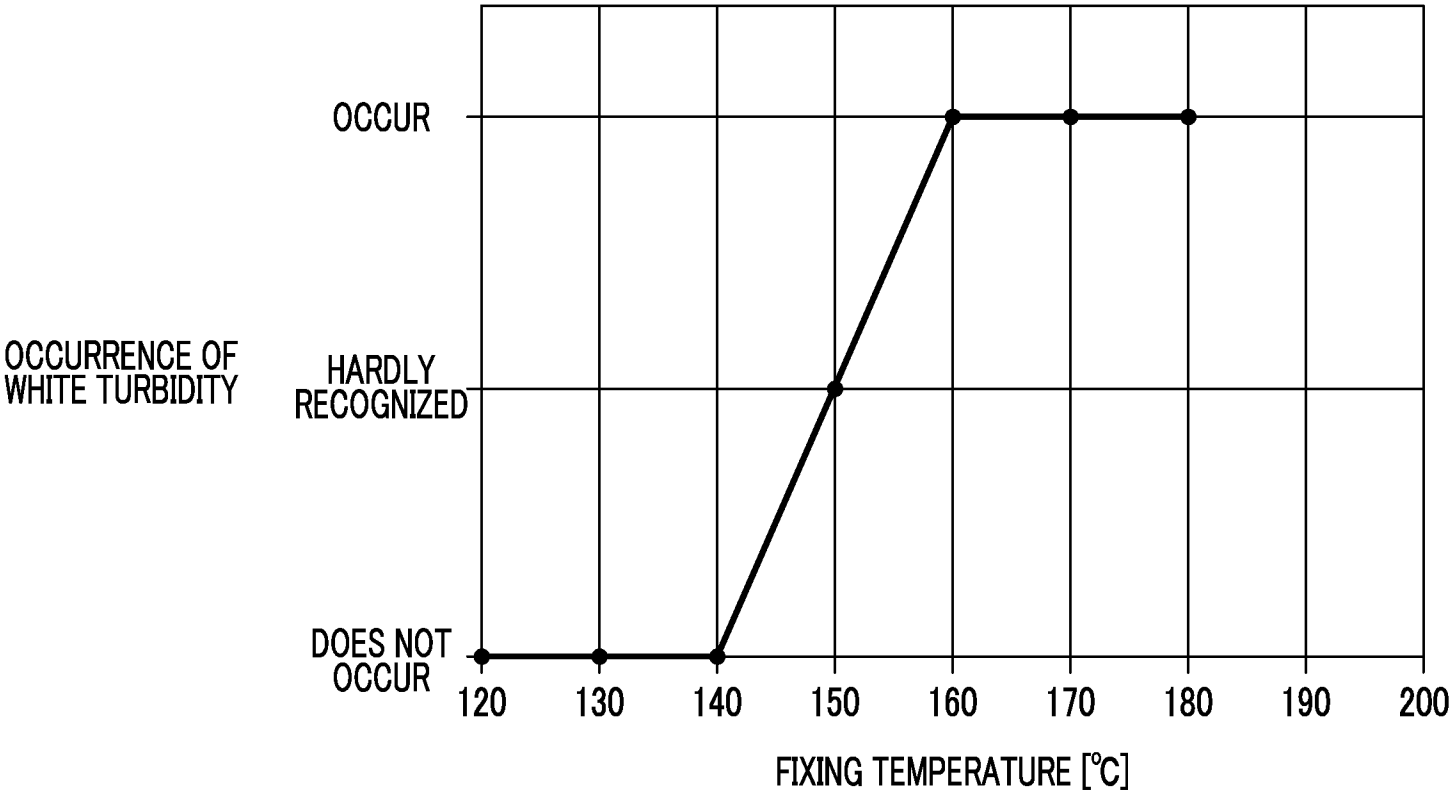
FIG. 5 is a graph illustrating a relationship between occurrence of white turbidity of the metallic paper and a fixing temperature.

FIG. 5 is a graph illustrating a relationship between the fixing temperature and occurrence of the white turbidity. From the graph, it can be understood that when the fixing temperature is 140° C. or lower, the white turbidity does not occur. It should be noted that the fixing speed at this time is 445 mm/s.

From this result, in the image forming apparatus 10 of this exemplary embodiment, in a case where the metallic standard paper 100S or the metallic cardboard 100T is selected, the control unit 70 switches (sets) the fixing temperature of the fixing device 40 from the standard first temperature (155° C.) to the second fixing temperature (140° C.). It should be noted that the second fixing temperature is equal to or lower than a temperature at which the white turbidity does not occur and that the second fixing temperature of this exemplary embodiment is 140° C. or lower as illustrated in FIG. 5.

Here, when the toner image is fixed to the metallic cardboard 100T at the second fixing temperature (140° C.) and at the first fixing speed, since the basis weight of the metallic cardboard 100T is large, the amount heat that is absorbed to the metallic cardboard 100T is large. Thus, the amount of heat applied to the toner image is insufficient by the amount of heat that is absorbed, and a fixing failure (cold off-set) may occur.

Accordingly, in a case where the metallic cardboard 100T is selected, the fixing speed of the fixing device 40 is switched (set) to the second fixing speed (200 mm/s) from the standard first fixing speed (445 mm/s). As described above, when the fixing speed is set to the second fixing speed that is slow, a fixing time it takes for a recording medium to pass through the fixing nip NF formed between the fixing belt 411 and the pressure roll 42 increases. As a result, the amount of heat applied to the toner image increases, and the fixing failure due to deficiency of the amount of heat is prevented.

It should be noted that the second fixing speed (200 mm/s) is equal to or slower than a fixing speed at which the fixing failure (cold off-set) of the toner image due to the deficiency of the amount of heat does not occur and that the second fixing speed is obtained in advance through an experiment, a simulation, and the like.

As described above, in the case where the user selects the metallic standard paper 100S, the control unit 70 sets the fixing temperature and the fixing speed of the fixing device 40 to the second fixing temperature and the first fixing speed, respectively. Thus, it is possible to suppress discoloration of the metallic standard paper 100S due to the fixing.

In the case where the user selects the metallic cardboard 100T having a large basis weight, the control unit 70 sets the fixing temperature and the fixing speed of the fixing device 40 to the second fixing temperature and the second fixing speed, respectively. Thus, it is possible to suppress that the fixing discolors the metallic cardboard 100T, and it is possible to prevent the fixing failure.

It should be noted that the second fixing temperature and the second fixing speed may be appropriately set depending on the entire configuration of the image forming apparatus 10, specifications of the metallic standard paper 100S and the metallic cardboard 100T, the basis weight of the metallic cardboard 100T, and the like.

Also, in this exemplary embodiment, in the case of the metallic cardboard 100T, the second fixing speed is set. However, the fixing failure may occur at the first fixing speed even though the metallic standard paper 100S is selected. In this case, the second fixing speed may be set. In brief, if the basis weight of the metallic paper 100 is greater than a threshold value that is determined in advance and if there is a concern that the fixing failure may occur, the second fixing speed, at which the fixing failure does not occur, may be set.

Also, in this exemplary embodiment, if the basis weight of the metallic paper 100 is greater than the threshold value that is determined in advance and if there is a concern that the fixing failure may occur, the second fixing speed, at which the fixing failure does not occur, is set. However, exemplary embodiments are not limited thereto. In a case where the metallic paper 100 is selected, the second fixing speed may be set regardless of the basis weight thereof.

Modification Example

Next, description will be given of a modification example of this exemplary embodiment.

In this modification example, in a case where the metallic cardboard 100T is selected, the second fixing temperature is set, and an upper limit of a toner weight per unit area of the toner image that is transferred to the metallic cardboard 100T is set to a value that is determined in advance. The upper limit is equal to or less than the toner weight per unit area of the toner image at which the fixing failure (cold off-set) does not occur, and in this modification example, the upper limit is 7 $g/m^2$ or less.

Specifically, in a case where the upper limit of the toner weight per unit area of the toner image in which a dot area ratio (Cin) is 90%, even in a toner image in which the dot area ratio (Cin) on image data is 90% or greater, an image is formed as a toner image in which the dot area ratio (Cin) is less than 90%. For example, even in a case of a so-called solid image in which the dot area ratio (Cin) on the image data is 100%, the image is set to have the dot area ratio (Cin) that is less than 90%.

As described above, in a case where the metallic cardboard 100T is selected, since the upper limit of the toner weight per unit area of the toner image is set to be equal to or less than the toner weight at which the fixing failure does not occur, it is possible to prevent the fixing failure.

It should be noted that if the upper limit of the toner weight per unit area of the toner image is set to a value that is determined in advance at which the fixing failure does not occur, the maximum value of an image concentration decreases. Specifically, even in a case of a so-called solid image in which the dot area ratio (Cin) is 100% as described above, an image, in which the dot area ratio (Cin) is less than 90%, is obtained.

However, when the upper limit of the toner weight per unit area of the toner image is set to be equal to or less than the toner weight, at which the fixing failure does not occur, not in consideration of a decrease in image quality due to discoloration of the metallic cardboard 100T, the decrease in the maximum value of the image concentration, which occurs, has a small effect on the image quality.

In this modification example, in a case of the metallic cardboard 100T, the upper limit of the toner weight per unit area of the toner image is set. However, in a case where there is a concern that the fixing failure may occur even if the metallic standard paper 100S is employed, the upper limit of the toner weight per unit area of the toner image may be set. In brief, if the basis weight of the metallic paper 100 is greater than the threshold value that is determined in advance and if there is a concern that the fixing failure may occur, the upper limit of the toner weight per unit area of the toner image may be set in order for the fixing failure not to occur.

In a case where the metallic cardboard 100T is selected, the second fixing speed may be set, and the upper limit of the toner weight per unit area of the toner image may be set to a value that is determined in advance.

<Others>

However, the invention is not limited to the exemplary embodiments.

In the exemplary embodiment, the fixing speed of the fixing device 40 is set to the second fixing speed that is slow, in order to increase the fixing time it takes for a recording medium to pass through the fixing nip NF formed between the fixing belt 411 and the pressure roll 42 and to increase the amount of heat that is applied to the toner image. However, a width of the fixing nip NF, which is formed between the fixing belt 411 and the pressure roll 42, may be increased without the fixing speed being changed, so as to increase the fixing time it takes for a recording medium to pass through the fixing nip NF and to increase the amount of heat that is applied to the toner image.

It should be noted that the method of broadening the width of the fixing nip NF may be any method. For example, the width of the fixing nip NF may be broadened by increasing a pressurizing force of the pressure roll 42.

Also, in the exemplary embodiment, the user operates the operation panel 15 to select the standard paper, the metallic standard paper 100S, and the metallic cardboard 100T, but there is no limitation thereto. The standard paper, the metallic standard paper 100S, and the metallic cardboard 100T may be detected with a sensor and the like for selection.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that forms a toner image and transfers the toner image to a recording medium; and a fixing section that heats the recording medium, to which the toner image is transferred, to fix the toner image to the recording medium, and is capable of switching a fixing temperature between a first fixing temperature and a second fixing temperature lower than the first fixing temperature, wherein if the recording medium is metallic paper including a metallic layer and a resin layer that covers the metallic layer, the fixing section heats the recording medium at the second fixing temperature to fix the toner image to the recording medium.

2. The image forming apparatus according to claim 1, wherein the fixing section is capable of switching a fixing time between a first fixing time and a second fixing time longer than the first fixing time, and if a basis weight of the metallic paper is greater than a first threshold value that is determined in advance, the fixing section heats the recording medium for the second fixing time to fix the toner image to the recording medium.

3. The image forming apparatus according to claim 2, wherein the image forming section is capable of setting an upper limit of a toner weight per unit area of the toner image, which is transferred to the metallic paper, to a value that is determined in advance, and if the basis weight of the metallic paper is greater than a second threshold value that is set in advance, the image forming section forms the toner image in a state in which the upper limit of the toner weight per unit area is set to the value that is determined in advance.

4. The image forming apparatus according to claim 2, wherein the second fixing temperature is set in advance so that if the recording medium is the metallic paper and if the fixing section heats the recording medium at the second fixing temperature to fix the toner image to the recording medium, no white turbidity occurs in the recording medium.

5. The image forming apparatus according to claim 1, wherein the image forming section is capable of setting an upper limit of a toner weight per unit area of the toner image, which is transferred to the metallic paper, to a value that is determined in advance, and if the basis weight of the metallic paper is greater than a second threshold value that is set in advance, the image forming section forms the toner image in a state in which the upper limit of the toner weight per unit area is set to the value that is determined in advance.

6. The image forming apparatus according to claim 1, wherein the fixing section is capable of switching a fixing time between a first fixing time and a second fixing time longer than the first fixing time, and if the recording medium is the metallic paper, the fixing is performed for the second fixing time.

* * * * *